US005787791A

United States Patent [19]

Vertanen

[11] Patent Number: 5,787,791

[45] Date of Patent: Aug. 4, 1998

[54] TURBOCHARGER ACTUATOR WITH ROLLING O-RING

[75] Inventor: Mark W. Vertanen, Creston, Iowa

[73] Assignee: Gits Manufacturing Company, Creston, Iowa

[21] Appl. No.: 821,276

[22] Filed: Mar. 20, 1997

[51] Int. Cl.[6] ..... F01B 31/00

[52] U.S. Cl. ..... 92/107; 92/164; 92/130 R; 92/165 R; 277/173; 277/177

[58] Field of Search ..... 277/173, 176, 277/177; 92/107, 108, 163, 164, 130 R, 165 R

[56] References Cited

U.S. PATENT DOCUMENTS

| | | | |
|---|---|---|---|
| 2,955,578 | 10/1960 | Flessate | 92/107 |
| 3,116,932 | 1/1964 | Mallinckrodt | 277/177 |
| 3,188,922 | 6/1965 | Cruse | 92/107 |
| 4,418,924 | 12/1983 | Mack | 277/173 |
| 4,899,642 | 2/1990 | Hwang | 92/108 |
| 4,948,351 | 8/1990 | Williams | 277/177 |
| 4,961,372 | 10/1990 | Leonhartsberger | 92/108 |

*Primary Examiner*—Thomas E. Denion
*Attorney, Agent, or Firm*—Zarley, McKee, Thomte, Voorhees, & Sease

[57] ABSTRACT

An actuator for a turbocharger includes a housing having a chamber therein, a piston assembly having a rod and a piston secured to a rod for axial movement therewith, a spring operatively interposed between the piston and the housing for urging the piston upward within the chamber. A hollow retainer is mounted to the housing and extends into the chamber alongside the piston. The retainer has a housed portion having a generally cupped shape with a cavity therein for receiving a pressure signal from the turbocharger. The retainer has axially spaced first and second peripheral protrusions thereon. An O-ring mounts on the retainer between the first and second protrusions and in engagement with the retainer and piston simultaneously. The O-ring rolls between the first and second protrusions in response to the pressure signal and the resulting relative axial movement between the retainer and piston, thus decreasing hysteresis in the actuator.

17 Claims, 1 Drawing Sheet

TURBOCHARGER ACTUATOR WITH ROLLING O-RING

BACKGROUND OF THE INVENTION

The present invention relates to the field of actuators. More particularly, the present invention relates to an actuator for an automotive turbocharger. The actuator of the present invention utilizes a rolling O-ring to decrease hysteresis and, in turn, improve the drivability of the turbocharged vehicle.

Typically, actuators for automotive turbochargers experience low to medium pressure, but must withstand a significant number of pressurization and/or vibration cycles. Some conventional actuators utilize an elastic diaphragm held between the cover and main body of a housing to react to the wastegate outlet pressure and thereby control the wastegate valve. However, these diaphragms may eventually wear out and develop holes due to vibration. Essentially, engine vibrations may shake the diaphragm in one spot until a hole develops.

Conventional O-ring seals used in air cylinders require high pressure to initiate movement. Such O-rings are not designed or intended to move across the groove. Hysteresis is often a significant factor in such systems. Typically, air cylinder O-rings are tightly constrained in a groove. The piston and its mating bore must also be machined to tight tolerances. Thus, air cylinder actuators having O-rings are costly to manufacture. There is a need for an inexpensive actuator that provides both low hysteresis and long life.

Therefore, a primary objective of the present invention is the provision of an improved actuator having a rolling O-ring.

A further objective of the present invention is the provision of an actuator which provides steady movement in response to changes in wastegate outlet pressure.

A further objective of the present invention is the provision of an actuator which improves the drivability of the vehicle.

A further objective of the present invention is the provision of an actuator which exhibits improved hysteresis over the standard diaphragm-type actuator.

A further objective of the present invention is the provision of a turbocharger actuator which is economical to produce, reliable, and durable in use.

These and other objectives will be apparent from the drawings and description which follows.

SUMMARY OF THE INVENTION

The present invention relates to an actuator for a turbocharger. The actuator includes a housing having a chamber therein, a piston assembly having a rod and a piston secured to the rod for axial movement therewith within the chamber, and a spring operatively interposed between the piston and the housing for urging the piston upward within the chamber. A hollow retainer is mounted to the housing and extends into the chamber alongside the piston. The retainer has a housed portion having a generally cupped shape with a cavity therein for receiving a pressure signal from the turbocharger. The retainer has axially spaced first and second peripheral protrusions thereon. An O-ring mounts on the retainer between the first and second protrusions and is in engagement with the retainer and piston simultaneously. The O-ring draggingly rolls between the first and second protrusions in response to the pressure signal from the turbocharger and the resulting relative axial movement between the retainer and the piston. This arrangement decreases hysteresis in the actuator. Furthermore, the actuator is less costly to produce because fewer tight tolerance machining steps are required.

DETAILED DESCRIPTION OF THE PREFERRED EMBODIMENT

Figure 1:
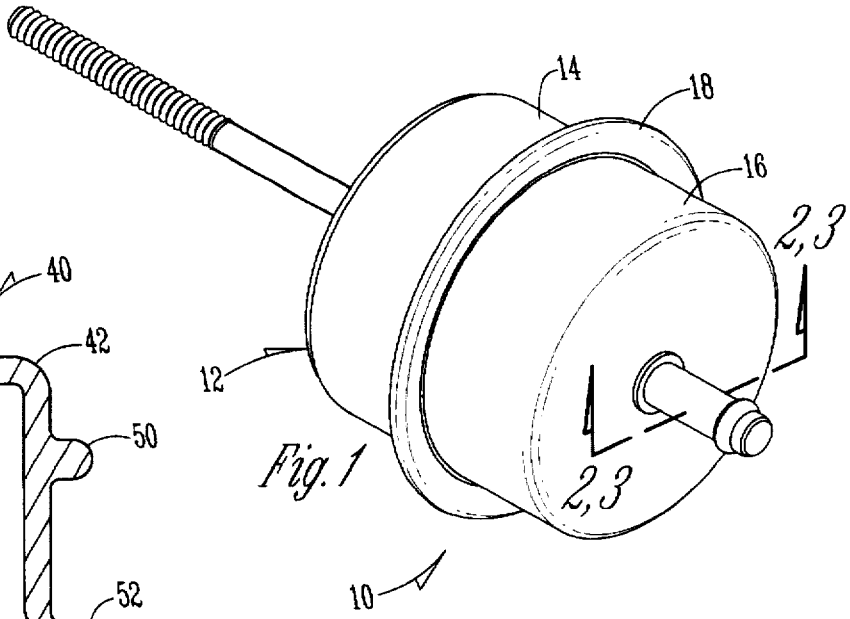
FIG. 1 is a perspective view of the actuator of the present invention.

The actuator of the present invention is generally shown in FIG. 1 and designated by the reference numeral 10. The actuator includes a housing 12, which has a body 14 and a cover 16 crimped together along a seam 18 so as to form a chamber 20 (FIG. 2) therein. Those skilled in the art will understand that the pressure in the chamber 20 is relatively low (less than approximately 100 pounds per square inch (psi)). Therefore, the housing can be inexpensively produced by forming it from plastic or drawn metal. The housing 12 includes a lower opening 22 in the body 14 and an upper opening 24 registered therewith in the cover 16.

A piston assembly 26 includes a rod 28 and a piston 30 secured to the rod 28 for axial movement within the chamber 20. Preferably, the rod 28 is threaded at its exposed end for connection with the wastegate valve. The piston 30 is formed with a cavity 31 therein and attached to the rod 28 in a sealed manner so that pressure within the cavity 31 cannot escape past the rod 28. The piston 30 is preferably cup-shaped. The piston 30 has a cylindrical portion with a substantially circular cross-section in a horizontal plane and a rim 32 extending radially outward from the cylindrical portion. The rim 32 has a substantially flat seat portion 33 interposed between the cylindrical portion of the piston 30 and the outer edge of the rim 32. The outer edge of the rim 32 extends downwardly from the seat portion 33 to form a guide lip 35.

A bushing 34 is disposed in the chamber 20 adjacent the bottom of the body 14. The bushing 34 has a hole 36 therethrough for guidingly receiving the rod 28 of the piston assembly 26. The rod 28 slides freely within the hole 36. In addition to guiding the rod 28, the bushing 34 also provides a seat and guide for a spring 38 which is operatively interposed between the housing 12 and the piston assembly 26. The spring 38 urges the piston 30 upward within the chamber 20. The spring 38 is a coil compression spring which has an inside diameter sufficient to receive the cylindrical portion of the piston 30. Similar to the piston rim 32, the bushing 34 has a substantially flat seat portion 37 which extends radially outward to terminate in an upwardly turned edge 39 which acts as a guide lip for inhibiting lateral movement of the spring 38. Thus, the spring 38 is loosely, but securely, held between the bushing 34 and the rim 32 of the piston 30.

An elongated hollow retainer 40 is mounted to the housing cover 16 and extends into the chamber 20, more specifically into the cavity 31 alongside the piston 30. The retainer 40 has an inverted goblet shape and comprises a cup-shaped housed portion 42 and a hollow stem 44 extending therefrom. The housed portion 42 has a cavity 43 therein in fluid communication with the wastegate outlet pressure from the turbocharger. The stem 44 extends from the cup-shaped portion 42 through the upper opening 24 in the housing 12. An annular groove 46 on the outer diameter of the stem 44 receives a retaining ring 48 to secure the retainer 40 to the housing 12. The retaining ring 48 and the abutment of the housing cover 16 with the top of the cup-shaped portion 42 of the retainer, prevent the axial movement of the retainer 40. Thus, the retainer 40 is axially fixed with its cup-shaped portion 42 extending into the cavity 31 of the piston 30.

Figure 4:
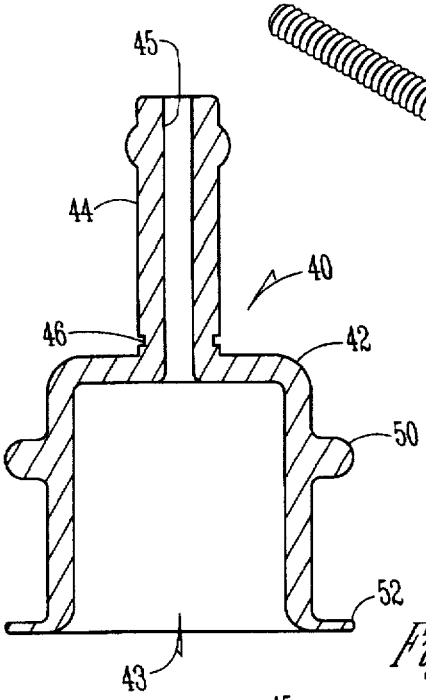
FIG. 4 is an enlarged cross-sectional view of the retainer of the present invention.

As best seen in FIG. 4, the cup-shaped portion 42 of the retainer 40 has protrusions 50, 52 extending outwardly therefrom. An O-ring 54 is mounted on the cup-shaped portion 42 of the retainer 40 between the protrusions 50, 52. Preferably, the O-ring 54 has a circular cross-section and is preferably formed of a fluorocarbon material. Such an O-ring is available from Wynn's Precision Company of Lebanon, Tenn., USA.

The first protrusion 50 preferably has a height greater than approximately one half the nominal thickness of the O-ring (in an uncompressed state). The protrusion 50 is rounded at its crest so as not to pinch or cut the O-ring 54. The second protrusion 52 is a finger-like flange extending outwardly from the cup-shaped portion 42 at its lower opening. For similar reasons, the second protrusion 52 extends outwardly approximately the same distance as the first protrusion 50. Generous radiuses are also provided at the base of the protrusions 50, 52, but a substantially smooth, cylindrical surface extends between the protrusions and radii for the O-ring to roll along.

The stem 44 has a hole 45 therein which puts the cavity 43 of the retainer 40 in fluid communication with the wastegate outlet pressure when the appropriate conventional hose or tubing (not shown) is connected to the stem 44.

Figure 2:
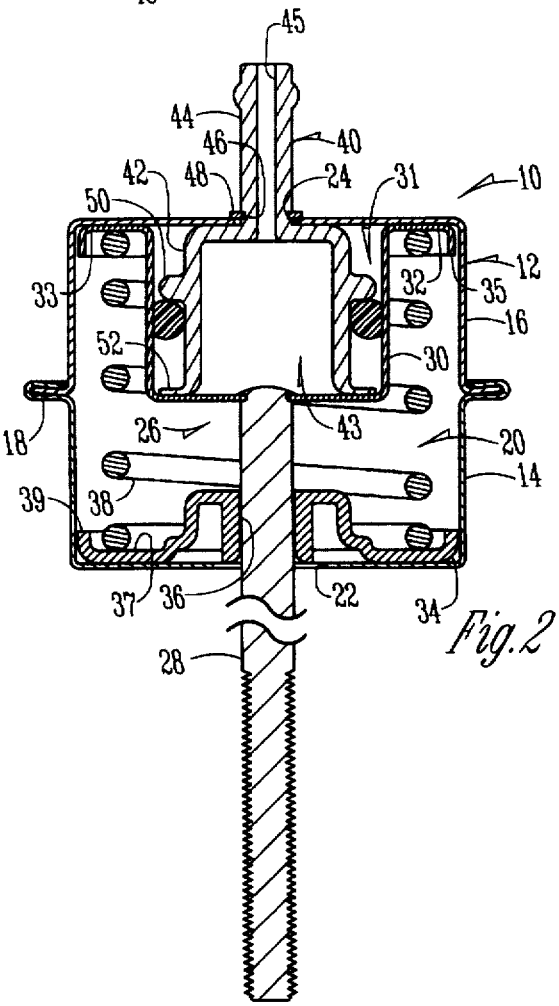
FIG. 2 is a cross-sectional view taken along line 2—2 of the actuator of FIG. 1 with the piston and O-ring in their uppermost positions.
Figure 3:
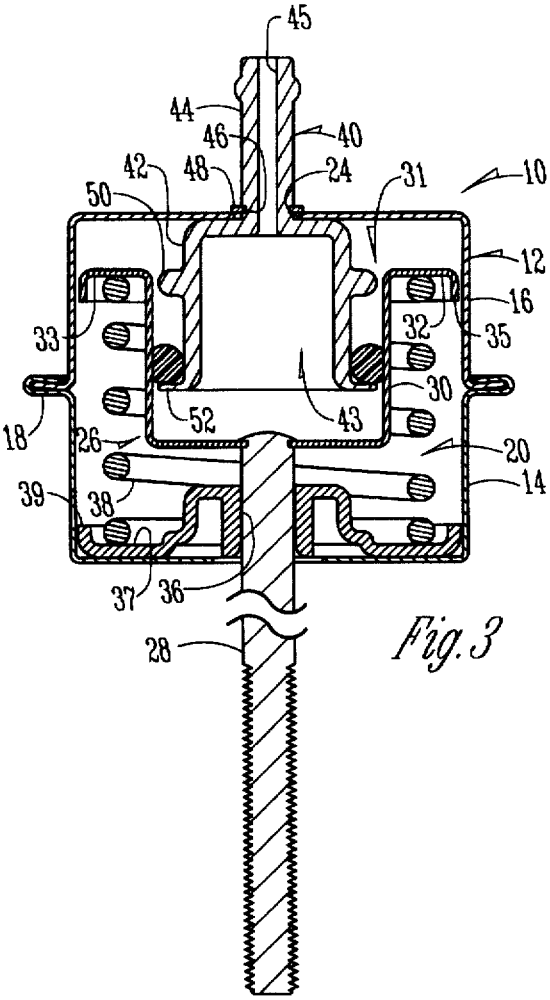
FIG. 3 is a cross-sectional view, similar to FIG. 2, but taken along line 3—3 and showing the piston and O-ring in lowered positions.

The operation of the present invention is best illustrated by FIGS. 2 and 3. FIG. 2 illustrates the condition where a negligible pressure is present at the wastegate outlet. The pressure in the cavity 43 of the retainer 40 is insufficient to overcome the force of the spring 38 and therefore cannot depress the piston assembly 26. The O-ring 54 rests against the first protrusion 50 in this condition. The O-ring 54 is also slightly compressed between the inner wall of the piston 30 and the outer wall of the retainer 40.

As the pressure at the wastegate outlet increases, the pressure in the cavity 43 of the retainer becomes sufficient to push the piston assembly 26 downward, as shown in FIG. 3. The O-ring 54 maintains contact with the inner wall of the piston 30, and thus is rolled downward. When exposed to significant pressure for a sufficient time, the O-ring 54 comes to rest on the second protrusion 52. The O-ring 54 also maintains contact with the outer periphery of the retainer 40 so that it is compressed between the retainer 40 and the piston 30, providing an adequate pressure seal therebetween. The piston 30 drags, rolls, and or slides the O-ring 54 between the protrusions 50, 52 in response to pressure changes at the wastegate outlet valve.

It is contemplated that the relative sizes of the cavities 31, 43 could be reversed and the retainer 40 could be adapted to receive the piston 30 within the retainer cavity 43. The protrusions 50, 52 could then be positioned on the inner walls of the retainer 40. The O-ring 54 would then be rollable between the inner wall of the retainer 40 and the outer wall of the piston 30.

Thus, it can be seen that the present invention at least accomplishes its stated objectives.

In the drawings and specification there has been set forth a preferred embodiment of the invention, and although specific terms are employed, these are used in a generic and descriptive sense only and not for purposes of limitation. Changes in the form and the proportion of parts as well as in the substitution of equivalents are contemplated as circumstances may suggest or render expedient without departing from the spirit or scope of the invention as further defined in the following claims.

What is claimed is:

1. An actuator for a turbocharger comprising:

a housing having a chamber therein;

a piston assembly having a piston secured to a rod for axial movement within the chamber;

a spring operatively interposed between the piston and the housing for biasing the piston toward a first position;

a retainer mounted to the housing so as to extend into the chamber alongside the piston, the retainer being adapted to receive a pressure signal from the turbocharger to overcome the spring and cause relative axial movement between the piston and the retainer, the retainer having axially spaced first and second peripheral protrusions thereon;

an O-ring mounted on the retainer between the first and second peripheral protrusions so as to engage both the retainer and the piston simultaneously;

whereby the O-ring moves between the first and second protrusions in response to the pressure signal from the turbocharger and the resulting relative axial movement of the retainer and the piston.

2. The actuator of claim 1 wherein the O-ring has a circular cross-section.

3. The actuator of claim 1 wherein the O-ring is formed from a fluorocarbon material.

4. The actuator of claim 1 wherein the O-ring seals an annular gap between the piston and the retainer.

5. The actuator of claim 1 wherein the first and second protrusions are on an outer diameter of the retainer.

6. The actuator of claim 1 wherein the O-ring has a cross-sectional diameter and the first and second protrusions both have a protrusion height greater than one-half the cross-sectional diameter of the O-ring.

7. The actuator of claim 1 wherein the housing comprises a body member and a cover attached to the body member.

8. The actuator of claim 7 wherein the body member has a hole therein for receiving the rod of the piston assembly and the cover has a hole for receiving the retainer.

9. The actuator of claim 1 wherein the spring is a coil compression spring.

10. The actuator of claim 1 wherein the retainer and the piston are generally cylindrical.

11. The actuator of claim 1 wherein the piston is cup-shaped with a cavity therein and has a rim extending outwardly to engage and seat the spring.

12. The actuator of claim 11 wherein the rim of the piston has a downturned outer edge for inhibiting lateral movement of the spring.

13. The actuator of claim 1 wherein the piston has a cavity therein and a portion of the retainer is disposed in the cavity of the piston.

14. The actuator of claim 1 wherein the retainer is an inverted goblet-shaped hollow member.

15. The actuator of claim 1 further comprising a bushing having an opening therein for guiding the rod for sliding movement into the housing.

16. The actuator of claim 15 wherein the bushing is disposed in the chamber of the housing and extends radially outward from the opening so as to engage the spring and provide a spring seat.

17. The actuator of claim 16 wherein the bushing has an upwardly directed outer peripheral edge that extends around the spring so as to guide the spring by limiting lateral movement thereof.

* * * * *